United States Patent [19]

Amaya et al.

[11] Patent Number: 4,931,370

[45] Date of Patent: Jun. 5, 1990

[54] COLOR TONER COMPOSITION FOR DEVELOPING ELECTROSTATIC IMAGES

[75] Inventors: Shinji Amaya, Saitama; Yoshiyuki Iwanari, Tokyo; Kinji Shinzo, Chiba; Toshiro Kogawara, Saitama; Syuuichi Yamazaki, Saitama; Seiichi Shimizu, Saitama; Kazuya Kuriyama, Chiba, all of Japan

[73] Assignee: Dainippon Ink and Chemicals, Inc., Tokyo, Japan

[21] Appl. No.: 284,043

[22] Filed: Dec. 14, 1988

[30] Foreign Application Priority Data

Dec. 15, 1987 [JP] Japan ..... 62-315176
May 30, 1988 [JP] Japan ..... 63-130422

[51] Int. Cl.[5] ..... G03G 9/08

[52] U.S. Cl. ..... 430/45; 430/106; 430/109; 430/904; 525/43; 525/46; 525/49

[58] Field of Search ..... 430/106, 904, 45, 109; 525/43, 46, 49

[56] References Cited

U.S. PATENT DOCUMENTS 4,797,340 1/1989 Tanaka et al. ..... 430/109
4,810,612 3/1989 Ueda et al. ..... 430/109
4,845,006 7/1989 Matsubara et al. ..... 430/109

FOREIGN PATENT DOCUMENTS 59-189350 10/1984 Japan ..... 430/109

*Primary Examiner*—Paul R. Michl
*Assistant Examiner*—Jeffrey A. Lindeman
*Attorney, Agent, or Firm*—Armstrong, Nikaido Marmelstein, Kubovcik & Murray

[57] ABSTRACT

A color toner composition for developing electrostatic images comprises a coloring agent and a binder resin, wherein the binder resin is a vinyl-modified polyester resin obtained by graft polymerizing (a) a vinyl monomer containing an aromatic vinyl monomer and an amino group-containing vinyl monomer to (b) an unsaturated polyester comprising at least aliphatic unsaturated dibasic acid and polyhydric alcohol having a weight average molecular weight of about 5,000 to 15,000, and the component (b) constitutes at least 50% by weight of the vinyl-modified polyester resin and the amino group-containing vinyl monomer constitutes 2 to 20% by weight of the vinyl-modified polyester resin.

10 Claims, No Drawings

COLOR TONER COMPOSITION FOR DEVELOPING ELECTROSTATIC IMAGES

FIELD OF THE INVENTION

The present invention relates to a positively chargeable color toner composition for use in development of electrostatic images in electrophotography, electrostatic recording, electrostatic printing and so on.

BACKGROUND OF THE INVENTION

The electrophotographic method for forming a visible image comprises forming an electrostatic latent image on an electrostatic image-carrying substrate comprising a photoconductive light-sensitive material by charging and exposing thereof to light; developing the latent image with a toner composition comprising a binder resin and a coloring agent and transferring and fixing the toner image obtained to a support, e.g., a transfer paper.

As the method for developing electrostatic images, a method in which to an electrostatic latent image formed on a light-sensitive material are attached developer particles (toner) having triboelectric charge of the opposite polarity to the latent image through Coulombic attraction (normal development), and a method in which toners having triboelectric charge of the same polarity as of the latent image are attached by an electric field between a magnetic developing brush and a light-sensitive material (reversal development) are known. The light-sensitive material is charged positively or negatively depending on the type thereof and is exposed to light corresponding to information to form an electrostatic latent image and, thereafter, the latent image is developed by the normal or reversal developing method. Thus, the polarity of the toner to be used is determined by a combination of the charged polarity of the light-sensitive material and the normal or reversal development. For example, in a laser beam printer in which imagewise exposure is applied using laser beam to selenium (negatively charged) to carry out the reversal development, a positively chargeable toner is used.

A toner image formed on the light-sensitive material is transferred to paper, overhead projector (hereinafter referred to as "OHP") sheets, and so forth and then fixed by utilizing heat, pressure, solvent vapor or electromagnetic waves. As the fixing method, a heat roller system using heat and pressure in combination is recently most widely used because it is excellent in heat efficiency.

As the toner composition to obtain a visible image, a composition comprising a binder resin and a black coloring agent such as carbon black dispersed therein is commonly used. In recent years, color toners prepared by dispersing cyan pigment, magenta pigment or yellow pigment in a binder have been used. Among the color toners which are used to obtain a panchromatic image by the electrophotographic method, usually color toners of cyan, magenta and yellow colors are used.

For such color toners are required to project a color image formed by transferring and fixing on an OHP sheet on a screen by a transmitted light through OHP.

The color toner generally comprises a binder resin, a coloring agent as main components and various additives. As the binder resin, polystyrene, a styrene-(meth-)acrylic acid ester copolymer, a styrene-butadiene copolymer, polyester, an epoxy resin, a cumaron-indene resin and the like are generally used. In particular, a polyester resin is firstly used due to relatively good in fixing properties and good in transmitting properties through OHP.

The polyester resin, however, is inherently negatively chargeable and, therefore, for positive charging it is necessary to add a charge-controlling agent. As the charge-controlling agent for positive charge which is added, nigrosine dyes are widely used. Since, however, the nigrosine dyes produce strong coloration and cannot produce an inherent color of the coloring agent they therefore, cannot be used in the color toner. As a colorless or light colored charge-controlling agent, various quaternary ammonium compounds have been proposed. These quaternary ammonium compounds are not sufficiently effective in permitting positive charging, and strongly negatively chargeable toners are produced from the polyester resin, thereby suffering from problems such as scattering of toners from a developing machine and producing fog on the image.

To achieve suitable positive charging, a method of adding a separately synthesized amino group-containing vinyl polymer to the polyester resin and kneading them together is described in JP-A-61-105562 (the term "JP-A" as used herein refers to a "published unexamined Japanese patent application"). However, compatibility of the polyester resin with an amino group-containing vinyl polymer is not necessarily high. Thus, micro phase separation occurs at the time of kneading and cooling in production of toners, and negatively chargeable toners are formed owing to the inherent nature of the polyester resin, thereby causing problems such as fogging of a base, scattering of the toner, and unsatisfactory transfer. Furthermore, the micro phase separation deteriorates the light transmitting properties of the toner, and a problem arises in that when an OHP sheet is used, a transmitted image which is blackish and of low saturation is obtained.

SUMMARY OF THE INVENTION

An object of the present invention is to provide a polyester resin-based color toner composition for developing electrostatic images, which realizes a suitable positive charging and produces images excellent in light transmitting properties.

The present invention provides a color toner composition for developing an electrostatic image, comprising a coloring agent and a binder resin, wherein the binder resin is a vinyl-modified polyester resin as obtained by graft polymerizing (a) vinyl monomers containing an aromatic vinyl monomer and an amino group-containing vinyl monomer to an (b) unsaturated polyester comprising at least an aliphatic unsaturated dibasic acid and a polyhydric alcohol, and the component (b) is at least 50% by weight, based on the total weight of the vinyl-modified polyester resin, and the amino group-containing vinyl monomer is at least 2 to 20% by weight based on the total weight of the vinyl-modified polyester resin.

DETAILED DESCRIPTION OF THE INVENTION

The color toner using the vinyl-modified polyester resin according to the present invention is positively chargeable when mixed with a carrier substance, e.g., iron powder, iron oxide powder and ferrite magnetic powder.

The unsaturated polyester is a polycondensate of aliphatic dibasic acid and polyhydric alcohol and preferably has a softening point of 80 to 150° C. so as to be formed in a powdery state as well as from a viewpoint of fixability to a copying paper.

The examples of polyhydric alcohol include diols containing a propylidenediphenyl group in the molecule thereof, which are hydrogenated bisphenol A, and propylene oxide or ethylene oxide adduct of bisphenol A. The average mole number of addition of propylene oxide or ethylene oxide in the above oxide adduct is preferably 2 to 7. An adduction obtained by adding both propylene oxide and ethylene oxide may be used. As the polyol component, diol other than the bisphenol type, may be added in a proportion of not more than about 10 mol % of the total polyol component. Examples of the polyol include ethylene glycol, propylene glycol, neopentyl glycol, and 3,3,5-trimethyl-2,4-pentanediol.

Further, ethylene glycol, triethylene glycol, 1,2-propylene glycol, 1,3-propylene glycol, 1,4-butanediol, neopentyl glycol, 1,4-butenediol, and 1,4-bis-(hydroxymethyl)cyclohexane may be used alone or in combination with each other.

As the aliphatic unsaturated dibasic acid, for example, maleic acid, maleic anhydride, fumaric acid, itaconic acid and citraconic acid can be used. Other polyhydric acid may be used in combination. As such polyhydric acids, phthalic anhydride, terephthalic acid, isophthalic acid, orthophthalic acid, hexahydrophthalic anhydride, tetrahydrophthalic anhydride, cyclohexanedicarboxylic acid, methylcyclohexanecarboxylic acid, mesaconic acid, glutaconic acid, succinic acid, maloic acid, glutaric acid, adipic acid, azelaic acid, sebacic acid, cyclohexanedicarboxylic acid, oxalic acid and other dibasic acids such as alkyl or alkenylsuccinic acid having 4 to 18 carbon atoms, and esters with lower alcohols may be used in combination.

In addition to the above component, a trifunctional compound such as trimellitic anhydride, glycerine and trimethylolpropane may be used in combination without causing gelation of the polyester resin. As a molecular weight adjusting agent of unsaturated polyester, a monofunctional compound such as benzoic acid and cyclohexanol may be used.

The weight average molecular weight of the unsaturated polyester is preferably in the range of 5,000 to 15,000. If the molecular weight is less than 5,000, the toner becomes brittle and its durability is reduced. On the other hand, with excess of 15,000, it is easily gelled in the graft polymerization and no desired graft polymer may be obtained.

The unsaturated polyester may be obtained by polycondensing a carboxylic acid component and a diol component in an inert gas atmosphere at a temperature of 180 to 250° C. In order to accelerate the reaction, an esterification catalyst commonly used, e.g., zinc oxide, stannous oxide, dibutyl tin oxide and dibutyl tin dilaurate may be used. For the same purpose as above, the polycondensation may be carried out under reduced pressure.

To the unsaturated polyester thus obtained is graft polymerized a vinyl monomer. This vinyl monomer contains an aromatic vinyl monomer and an amino group-containing monomer.

Examples of the amino group-containing vinyl monomer include dimethylaminoethyl methacrylate, diethylaminoethyl methacrylate, dimethylaminoethyl acrylate, and dimethylaminopropylmethacrylamide.

Examples of the aromatic vinyl monomer which is an essential component of the vinyl monomer are styrene, α-methylstyrene, vinyltoluene, and p-ethylstyrene.

Other vinyl monomers can be used in combination with the amino group-containing monomer and the aromatic vinyl monomer. Examples of the vinyl monomers are methacrylic acid alkyl esters such as methyl methacrylate, butyl methacrylate, octyl methacrylate, and stearyl methacrylate; acrylic acid alkyl esters such as ethyl acrylate, propyl acrylate, butyl acrylate and octyl acrylate; and acrylonitrile and acrylamide.

The unsaturated polyester constitutes at least 50% by weight, preferably 60 to 90% by weight, of the vinyl-modified polyester resin. If an amount of the unsaturated polyester is less than 50% by weight, the fixability of the toner and good leveling (surface smoothness) tend to be reduced.

The amino group-containing monomer constitutes 2 to 20% by weight of the vinyl-modified polyester resin. If an amount of the amino group-containing monomer is less than 2% by weight, suitable control of the amount of positive electric charge tends to become difficult. On the other hand, with more than 20% by weight, the fluidity and moisture-absorbing properties of the toner tend to be reduced.

The vinyl-modified polyester resin is obtained by graft polymerizing a vinyl monomer containing an amino group-containing and an aromatic vinyl monomer to the above unsaturated polyester.

In graft polymerization of the vinyl monomer, an amount of the unsaturated dibasic acid to be introduced in the above unsaturated polyester is preferably 0.2 to 2.0% by weight of the unsaturated polyester. If the amount of the unsaturated dibasic acid is less than 0.2% by weight, graft polymerization sometimes becomes difficult. On the other hand, with more than 2% by weight, a gelation is likely to occur easily. Among the aliphatic unsaturated dibasic acid, maleic anhydride is most suitable.

The graft polymerization reaction is carried out by the process of solution polymerization or suspension polymerization. In the case of the solution polymerization, the unsaturated polyester is dissolved in a solvent, e.g., xylene or toluene, and the vinyl monomer is added to the resulting solution along with a polymerization initiator and polymerized in an inert gas atmosphere at a temperature of 60 to 150° C. In the case of the suspension polymerization, the unsaturated polyester and the polymerization initiator are dissolved in the vinyl monomer, and the resulting solution is suspended and dispersed in water containing a suspension stabilizer and then polymerized. As the polymerization initiator, azo-based initiators, e.g., azobisisobutyronitrile and azobisdimethylvaleronitrile are suitable.

A weight average molecular weight of the vinyl-modified polyester resin is preferably 8,000 to 20,000. If necessary, a chain transfer agent, e.g., dodecylmercaptan and thiophenol may be used. If the weight average molecular weight of the polymer is less than 8,000, the binder resin is sometimes brittle and the durability of the toner is reduced. On the other hand, with more than 20,000, there cannot be obtained a toner composition having good fixability and levering.

The glass transition temperature of the vinyl-modified polyester resin of the present invention as determined by the differential thermal analytical method is preferably 50 to 80° C. and more preferably 55 to 75° C. If the glass transition temperature is too low, the toner blocking easily occurs. On the other hand, with too high, the fixability is reduced. In the present invention, a heat absorption peak temperature in the differential thermal analysis is defined as a glass transition temperature.

The melt viscosity of the vinyl-modified polyester resin as determined by the flow tester method is $10^4$ to $10^6$ poises, preferably $1\times10^4$ to $5\times10^5$ poises at 100° C. If the melt viscosity is too low, anti-offset properties are sometimes reduced. On the other hand, with too high, when the color toner is used in OHP, transmitted light is scattered because the toner layer fixed to the OHP sheet is poor in leveling, and thus only a transmitted image which is blackish and of low saturation is obtained.

The toner composition of the present invention is useful as a color toner, and coloring agents which can be used are shown below.

Yellow Organic Pigment

Benzidine-based pigment such as C.I. 21090 (pigment yellow 12), C.I. 21095 (pigment yellow 14), and C.I. 21100 (pigment yellow 13) and mixtures thereof.

Magenta Color Organic Pigment

Xanthene-based pigment Red 81 (C.I. 45160), quinacridone-based pigment, 2,9-dimethylquinacridone, methine-based pigment, astracrochicine dye, thioindigo-based Vat Red 2 (C.I. 788655) or azolake-based Brilliant Carmine 6B (C.I. 15850) and mixtures thereof.

Blue Color Organic Pigment

Compounds falling in the group of C.I. Pigment Blue 15, C.I. Pigment Blue 68 and C.I. Solvent Blue 70, or phthalocyanine-based pigments, e.g., C.I. Nos. 74260, 74280, 74255, 74160 and 74180 or mixtures thereof.

Black Color Pigment

Carbon #30, #33, #40, #44, #45, MA-8, MA-11, MA-100 (produced by Mitsubishi Kasei Corporation).

Vulcan XC-72R, Regal 400R, Carbolac 2, Monarch 81, Elftex 8, Regal 330R, Sterling 99R (produced by Cabot Corp.)

Printex U, Printex 140V, Lamp BLACK 700, Regent Super, Printex 60, Corax L (produced by Degussa AG)

United 3004, United 3012, United XC-3016 (produced by Ashland Chemical Corp.)

Oily Dye

C.I. Solvent Red 24, C.I. Solvent Violet 13, C.I. Solvent Blue 7, C.I. Solvent Blue 35, C.I. Solvent Green 35, C.I. Solvent Yellow 2, C.I. Solvent Yellow 14, C.I. Solvent Brown 5, C.I. Solvent Orange 7, C.I. Solvent Red 3..

In the present invention, a vinyl-modified polyester resin obtained by graft polymerizing an amino group-containing vinyl monomer to a polyester resin so as to react the amino group-containing vinyl monomer in a proportion of 2 to 10% by weight based on the total weight is used as a binder resin. Thus, a color toner for developing electrostatic image permits to obtain a suitable amount of positive charge and to obtain an image which is free from scattering of the toner and fog. Furthermore, the color toner is free from phase separation and negative charging as encountered in a toner using a binder resin obtained by adding an amino group-containing resin to a polyester resin, and thus does not produce problems such as fog of the background, scattering of toner, unsatisfactory transfer and insufficient light transmittance.

The color toner of the present invention provides a color image which is good in transparency and is sharp. In particular, a transmitted image excellent for the OHP sheet is obtained.

The present invention is described in greater detail with reference to the following examples. All parts are by weight.

EXAMPLE 1

Production of Vinyl-Modified Polyester Resin 68 parts of polyoxyethylene(2)-2,2-bis(4-hydroxyphenyl)propane, 16 parts of isophthalic acid, 16 parts of terephthalic acid, 0.3 part of maleic anhydride and 0.06 part of dibutyl tin dioxide were placed in a flask and then reacted in a nitrogen atmosphere at 230° C. for 24 hours.

The weight average molecular weight of the unsaturated polyester resin obtained was 11,000.

50 parts of the unsaturated polyester resin and 50 parts of xylene were placed in a flask and the unsaturated polyester resin was dissolved in the xylene. The temperature was raised until the xylene was refluxed, and while refluxing the xylene, a solution of 0.4 part of azobisisobutyronitrile in 13 parts of styrene and 2 parts of diethylaminoethyl methacrylate was added dropwise to the above solution over about 30 minutes in a nitrogen atmosphere. After the completion of the addition, the resulting mixture was kept warm for 3 hours. The xylene was distilled off under reduced pressure and the resin was taken out. The weight average molecular weight was 12,000, the melt viscosity at 100° C. was $5\times10^4$ poises, and the glass transition temperature was 62° C.

The melt viscosity was measured by the use of a flow tester CFT-500 (produced by Shimazu Corporation) having a nozzle 1 mm in diameter, and 1 mm in length, under load of 30 kg, and temperature raising rate of 3° C./min.

Preparation of Toner 92 parts of the vinyl-modified polyester resin obtained above, 4 parts of phthalocyanine pigment C.I. No. 74160 (Fastogen Blue GNPT, produced by Dainippon Ink And Chemicals Inc.), and 4 parts of Bontron P-51 (positive charge-controlling agent, produced by Orient Chemical Industries, Ltd.) were mixed in a ball mill and kneaded with a heat roll and, thereafter, cooled, pulverized and classified to obtain toners having an average particle diameter (weight average) of 11 μm. This toner is called "Toner 1".

EXAMPLE 2

Using 92 parts of the vinyl-modified polyester resin used in Example 1, 4 parts of benzidine pigment, C.I. No. 21095 (Symuler Fast Yellow 5GF, produced by Dainippon Ink And Chemicals Inc.) and 4 parts of a charge-controlling agent (Bontron P-51, produced by Orient Chemical Industries, Ltd.), toners were produced in the same manner as in Example 1. This toner is called "Toner 2".

EXAMPLE 3

Using 92 parts of the vinyl-modified polyester resin used in Example 1, 4 parts of quinacridone-based pigment, C.I. No. 73915 (Fastogen Super Magenta R, produced by Dainippon Ink And Chemicals Inc.) and 4 parts of a charge-controlling agent (Bontron P-51, produced by Orient Chemical Industries, Ltd.), toners were produced in the same manner as in Example 1. This toner is called "Toner 3".

COMPARATIVE EXAMPLE 1

A resin was produced in the same manner as in Example 1 except that maleic anhydride was not used. For this resin, the weight average molecular weight was 11,000, the glass transition temperature was 61° C., and the melt viscosity at 100° C. was $6\times10^4$ poises. In this resin, the vinyl monomer was not graft polymerized to the polyester; that is, the resin was a mixture of the vinyl homopolymer and the polyester resin. This toner is called "Toner 4".

COMPARATIVE EXAMPLE 2

A resin was produced in the same manner as in Example 1 except that diethylaminoethyl methacrylate was not used. The resin has the weight average molecular weight of 12,500, the melt viscosity at 100° C. of $6\times10^4$ poises and the glass transition temperature of 62° C.

Using the resin, toners were prepared in the same manner as in Example 1. This toner is called "Toner 5".

COMPARATIVE EXAMPLE 3

Using the unsaturated polyester resin obtained in Example 1, toners were prepared in the same manner as in Example 1. This toner is called "Toner 6".

The toners 1 to 6 were tested by the methods shown below. The results are shown in the table.

That is, 6 parts of each toner and 92 parts of a carrier having an average particle diameter of 74 μm covered with a silicone resin were mixed to prepare a developer.

By the use of an electrophotographic copying machine SF-8200 (produced by Sharp Co., Ltd.), an electrostatic latent image was formed and developed with the developer. The toner image thus obtained was transferred to a transferring paper and fixed by the use of a heat roller fixing machine to form a copied image. The fixing machine used silicone rubber and required coating with silicone oil.

Evaluation of the test results in Examples and Comparative Examples was carried out by the following methods.

(1) Image Density

A Macbeth reflective densitometer RD-918 (sold by Sakata Shokai Co., Ltd.) was used, and a developed image density at an original density of 1.3 was shown.

(2) Fog

A Macbeth reflective densitometer RD-918 (sold by Sakata Shokai Co., Ltd.) was used, and a difference between the developed image density of the background of the original and the reflective density of the transferring paper used was evaluated according to the following standards.

Less than 0.02: Good 0.02 or more: Bad (3) Sharpness

Reproducibility of a line chart of an original as the original was determined with the eye.

(4) Charge to Mass Ratio

A 30 second blow value as determined by the use of a blow off charging amount-measuring apparatus (produced by Toshiba Chemical Co., Ltd.) was shown.

(5) Transfer Ratio

The transfer ratio was calculated from the following equation:

$$\frac{A-B}{A}\times 100\ (\%)$$

where

A: amount of toner consumed,

B: amount of toner recovered.

| | | At Start | After 1,000 Sheet Copying | After 5,000 Sheet Copying | After 10,000 Sheet Copying |
|---|---|---|---|---|---|
| Toner 1 | Image Density | 1.53 | 1.50 | 1.54 | 1.50 |
| | Fog | good | good | good | good |
| | Sharpness | good | good | good | good |
| | Charge to Mass Ratio (μc/g) | +23.3 | +22.9 | +24.0 | +23.8 |
| | Transfer Ratio (%) | | | | 85.5 |
| Toner 2 | Image Density | 1.48 | 1.49 | 1.47 | 1.50 |
| | Fog | good | good | good | good |
| | Sharpness | good | good | good | good |
| | Charge to Mass Ratio (μc/g) | +25.1 | +24.6 | +24.8 | +24.3 |
| | Transfer Ratio (%) | | | | 86.1 |
| Toner 3 | Image Density | 1.50 | 1.52 | 1.48 | 1.53 |
| | Fog | good | good | good | good |
| | Sharpness | good | good | good | good |
| | Charge to Mass Ratio (μc/g) | +23.4 | +22.8 | +23.2 | +24.6 |
| | Transfer Ratio (%) | | | | 86.5 |
| Toner 4 | Image Density | 1.45 | 1.03 | 0.88 | 0.52 |
| | Fog | good | good | good | good |
| | Sharpness | good | bad | bad | bad |
| | Charge to Mass Ratio (μc/g) | +25.0 | +31.7 | +33.4 | +35.0 |
| | Transfer Ratio (%) | | | | 65.5 |
| Toner 5 | Image Density | 1.62 | 0.97 | — | — |
| | Fog | bad | bad | — | — |
| | Sharpness | bad | bad | — | — |
| | Charge to Mass Ratio (μc/g) | +9.5 | +5.3 | — | — |
| | Transfer Ratio (%) | Impossible continuous copying due to large toner scattering | | | |
| Toner 6 | Image Density | 0.84 | — | — | — |
| | Fog | bad | — | — | — |
| | Sharpness | bad | — | — | — |
| | Charge to Mass Ratio (μc/g) | +4.5 | — | — | — |
| | Transfer Ratio (%) | Impossible continuous copying due to large toner scattering | | | |

While the invention has been described in detail and with reference to specific embodiments thereof, it will be apparent to one skilled in the art that various changes and modifications can be made therein without departing from the spirit and scope thereof.

We claim:

1. A positively chargeable color toner composition for developing electrostatic images comprising a coloring agent and a binder resin, wherein the binder resin is a vinyl-modified polyester resin obtained by graft polymerizing:

(a) vinyl monmers containing both an aromatic vinyl monomer and an amino group-containing vinyl monomer onto (b) an unsaturated polyester comprising at least an aliphatic unsaturated dibasic acid and a polyhydric alcohol and having a weight average molecular weight of 5,000 to 15,000, and the component (b) constituents at least 50% by weight of the vinyl-modified polyester resin and the amino group-containing vinyl monomer constituents 2 to 20% by weight of the vinyl-modified polyester resin.

2. The color toner composition as claimed in claim 1, wherein the amino group-containing vinyl monomer constituents 2 to 10% by weight of the vinyl-modified polyester resin.

3. The color toner composition as claimed in claim 1, wherein the vinyl-modified polyester resin has a weight average molecular weight of 3,000 to 20,000, a melt viscosity at 100° C. of $1\times10^4$ to $1\times10^6$ poises, and a glass transition temperature of 50 to 80° C.

4. The color toner composition as claimed in claim 1, wherein the vinyl-modified polyester resin has a weight average molecular weight of 8,000 to 20,000, a melt viscosity at 100° C. of $1\times10^4$ to $1\times10^6$ poises, and a glass transition temperature of 50 to 80° C.

5. The color toner composition as claimed in claim 1, wherein the weight ratio of the unsaturated polyester (b) to the vinyl monomers (a) is 30:70 to 90:10.

6. The color toner composition as claimed in claim 1, wherein the coloring agent is cyan pigment, magenta pigment or yellow pigment.

7. The color toner composition as claimed in claim 2, wherein the coloring agent is cyan pigment, magenta pigment or yellow pigment.

8. The color toner composition as claimed in claim 3, wherein the coloring agent is cyan pigment, magenta pigment or yellow pigment.

9. The color toner composition as claimed in claim 4, wherein the coloring agent is cyan pigment, magenta pigment or yellow pigment.

10. The color toner composition as claimed in claim 5, wherein the coloring agent is cyan pigment, magenta pigment or yellow pigment.

* * * * *